US007950981B2

(12) United States Patent
Kamiya et al.

(10) Patent No.: US 7,950,981 B2
(45) Date of Patent: May 31, 2011

(54) PRECISION MACHINING APPARATUS AND PRECISION MACHINING METHOD

(75) Inventors: Sumio Kamiya, Toyota (JP); Hisao Iwase, Aichi-ken (JP); Tetsuya Nagaike, Toyota (JP); Hiroshi Eda, Kasama (JP); Libo Zhou, Hitachi (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 666 days.

(21) Appl. No.: 11/989,935

(22) PCT Filed: Aug. 3, 2006

(86) PCT No.: PCT/IB2006/002161
§ 371 (c)(1),
(2), (4) Date: Feb. 4, 2008

(87) PCT Pub. No.: WO2007/015163
PCT Pub. Date: Feb. 8, 2007

(65) Prior Publication Data

US 2010/0167627 A1 Jul. 1, 2010

(51) Int. Cl.
*B24B 49/00* (2006.01)
*B24B 51/00* (2006.01)

(52) U.S. Cl. ..... 451/5; 451/10; 451/11; 451/14

(58) Field of Classification Search ..... 451/5, 8, 451/10, 11, 14, 57, 58, 65, 66, 242, 246
See application file for complete search history.

(56) References Cited

U.S. PATENT DOCUMENTS

| | | | | |
|---|---|---|---|---|
| 3,728,826 | A * | 4/1973 | Wada et al. | 451/5 |
| 3,748,789 | A * | 7/1973 | Wada et al. | 451/14 |
| 4,294,045 | A * | 10/1981 | Enomoto et al. | 451/5 |
| 4,368,596 | A * | 1/1983 | Wada et al. | 451/5 |
| 5,006,685 | A * | 4/1991 | Hatano et al. | 219/69.2 |
| 6,426,232 | B1 | 7/2002 | Litvak | |
| 6,447,379 | B1 * | 9/2002 | Gromko et al. | 451/287 |
| 7,160,175 | B2 | 1/2007 | Kamiya et al. | |
| 7,247,081 | B2 | 7/2007 | Kamiya et al. | |

FOREIGN PATENT DOCUMENTS

EP 1 676 671 7/2006

(Continued)

OTHER PUBLICATIONS

International Search Report.

(Continued)

*Primary Examiner* — Timothy V Eley
(74) *Attorney, Agent, or Firm* — Finnegan, Henderson, Farabow, Garrett & Dunner, LLP

(57) ABSTRACT

A precision machining apparatus is structured such that a feed-screw mechanism and an actuator are mounted on a second mount which supports a rotating device that rotates a wheel, and grinding is performed while appropriately adjusting the amount of movement of the second mount in a rough grinding stage through an ultra-precision grinding stage. A posture control device is interposed between a first mount and a rotating device that rotates a grinding target body. The thickness and evenness of the grinding target body are measured by an optical probe and the measurement results are sent to a computer. A feedback command is then sent to the posture control device to reduce the difference between target values and the measurement values and posture control is performed accordingly.

10 Claims, 11 Drawing Sheets

FOREIGN PATENT DOCUMENTS

| | | |
|---|---|---|
| EP | 1 676 673 | 7/2006 |
| JP | 8-174417 | 7/1996 |
| JP | 2000-141207 | 5/2000 |
| JP | 2000-263416 | 9/2000 |
| JP | 2001-265441 | 9/2001 |
| JP | 2004-291209 | 10/2001 |
| JP | 2001-328065 | 11/2001 |
| JP | 2002-127003 | 5/2002 |
| JP | 2002-254264 | 9/2002 |
| JP | 2004-235201 | 8/2004 |
| TW | 355692 | 1/1987 |
| WO | WO 2006/107111 | 10/2006 |

OTHER PUBLICATIONS

Written Opinion of the ISR.
Notification of Reason(s) for Refusal for JP Appl. No. 2005-226419 dated Nov. 24, 2010.

* cited by examiner

| θ \ r | 0 | 4 | 8 | ..... | 148 |
|---|---|---|---|---|---|
| (360/1024)×0 | $Z_{0,0}$ | $Z_{0,4}$ | $Z_{0,8}$ | ..... | $Z_{0,148}$ |
| (360/1024)×1 | $Z_{1,0}$ | $Z_{1,4}$ | $Z_{1,8}$ | ..... | $Z_{1,148}$ |
| (360/1024)×2 | $Z_{2,0}$ | $Z_{2,4}$ | $Z_{2,8}$ | ..... | $Z_{2,148}$ |
| ⋮ | ⋮ | ⋮ | ⋮ | ⋮ | ⋮ |
| (360/1024)×1024 | $Z_{1024,0}$ | $Z_{1024,4}$ | $Z_{1024,8}$ | ..... | $Z_{1024,148}$ |

PRECISION MACHINING APPARATUS AND PRECISION MACHINING METHOD

BACKGROUND OF THE INVENTION

1. Field of the Invention

The invention relates to a precision machining apparatus and a precision machining method used when grinding a body to be ground (hereinafter also referred to as "grinding target body"), such as a silicon wafer or a magnetic disc substrate in which precise geometric accuracy and evenness are required. More particularly, the invention relates to a precision machining apparatus and precision machining method that is able to precisely control both the thickness and evenness of a body to be ground by performing feedback control when controlling the posture of a posture control device and controlling the amount that a moving portion which forms the precision machining apparatus is moved, throughout all of the stages of grinding from rough grinding to precision grinding.

2. Description of the Related Art

Recently, there is an increasing demand for next-generation power devices to be smaller and have less energy loss. High precision and multiple layering of semiconductors used in electronics are examples of this. In order to meet these needs, it is possible to develop various machining methods such as a machining method for making semiconductor wafers, which are represented by the Si wafer, extremely thin, in which there is no dislocation and lattice distortion on or in the machining surface, and a machining method in which the surface roughness (Ra) is on the sub-nanometer to nanometer level and the evenness of the machining surface is on the sub-micrometer to micrometer level or less.

With an eye toward the automotive industry, the IGBT (Insulated Gate Bipolar Transistor) which is a power device for automobiles is a main part of inverter systems. In the future, the productivity of hybrid vehicles is expected to rise increasingly as the performance of these inverters increases and their size decreases. Therefore, Si wafers that form these IGBTs will need to be extremely thin, with a thickness of approximately 50 to 150 μm and preferably 90 to 120 μm, and the switching loss, constant loss, and heat loss will all need to be reduced. Moreover, the yield ratio in the electrode formation process of the semiconductors and the multiple layering of the semiconductors will improve by having the perfect surface that has no dislocations, lattice distortion, or other such defects on the machining surface, or the inside near the machining surface, of a circular Si wafer that has a diameter of approximately 200 to 400 mm, and by having the surface roughness (Ra) on the sub-nanometer to nanometer level and having the evenness on the sub-micrometer to micrometer level.

Typically, machining of the foregoing semiconductor currently requires multiple processes such as rough grinding using a diamond wheel, rubbing, etching, and Wet-CMP (Wet-Chemo Mechanical Polishing) using loose grain. In this conventional machining method, oxidized layers, dislocation, and lattice distortion can occur in the machining surface, making it extremely difficult to obtain a perfect surface. Also, the evenness of the wafer is also poor which results in a lower yield ratio due to damage of the wafers that occurs during machining or after electrode formation. Furthermore, with the conventional machining method, as the diameter of the wafer increases from 200 mm, to 300 mm, to 400 mm, it becomes difficult to make the wafer extremely thin. As a result, research is currently underway to make the thickness of wafers having a diameter of 200 mm on the 100 μm level.

In view of the foregoing problems with the conventional technology, the inventors thus disclose in Japanese Patent Application Publication No. 2000-141207 an invention relating to a precision flat surface machining machine which is able to efficiently and consistently perform, using only a precision diamond wheel, all of the processes from rough-machining to ultra-precision surface machining including a final ductility mode process.

There are three main movements that are important in the grinding process to which the diamond wheel is applied: rotation of the wheel, advancing or feeding the main spindle that supports the wheel, and positioning the body to be machined. Precisely controlling these movements makes precision machining possible. However, in order to consistently perform all of the processes from rough-machining to ultra-precision machining with a single apparatus, of the main movements described above, the advancing or feeding of the main spindle in particular must be controlled with extreme precision over a wide range. To control the main spindle in the conventional grinding process, a method which applied a servo motor, for example, is widely used. This method, however, is unable to provide control from the low pressure range to the high pressure range with sufficient precision. In particular, this method is unable to yield sufficient machining in the low pressure region in which ultra-precision machining is performed. The inventors therefore disclose in Japanese Patent Application Publication No. 2000-141207 a precision machining machine which performs pressure control by combining a servo motor with a super magnetostrictive actuator. The servo motor and a piezoelectric actuator are used in a pressure range of 10 gf/cm$^2$ or greater and the super magnetostrictive actuator is used in a pressure range of 10 gf/cm$^2$ to 0.01 gf/cm$^2$. As a result, all of the processes from the rough machining to the ultra-precision machining can be performed consistently with a single apparatus. Also, the grinding wheel is a diamond cup wheel with a grit number finer than 3000.

It is important to check during the grinding process of the wafer surface of the semiconductor to make sure that the wafer has the desired thickness and that the wafer surface has the desired evenness not only when the product is finished but also in the grinding stage. Even though the grinding apparatus is controlled by a high performance actuator, as described above, checking the actual evenness and the like of the ground surface and feeding back the results to the next grinding process enables better machining accuracy to be obtained. Japanese Patent Application Publication No. JP-A-8-174417 discloses an invention relating to a grinding method which calculates the grinding amount from the difference in a disc-shaped sample thickness before and after grinding and keeps the grinding amount within an allowable range while changing the grinding conditions or replacing the grinding pad or the like when the calculated grinding amount deviates from an acceptable value.

In polishing or grinding control of a typical wafer, as described in Japanese Patent Application Publication No. JP-A-8-174417 above, the method typically employed calculates the grinding amount from the difference in wafer thickness before and after grinding and performs machining while determining whether the grinding amount is within the allowable range. However, as described in Japanese Patent Application Publication No. 2000-141207, with a grinding apparatus that can perform grinding from rough machining to ultra-precision machining consistently by controlling the pressure while grinding using a combination of a servo motor with a super magnetostrictive actuator, calculating the difference and the like in the wafer thickness before and after machining interferes with the speed that can be expected from grinding consistently from rough machining to ultra-precision machining. Also, when grinding from rough machining to ultra-precision machining, it is extremely difficult to precisely control the surface machining precision, thickness, and evenness and the like of the wafer from the amount of grinding. That is, when the grinding precision at the end of the rough machining is to be determined by the amount of grinding, it is not possible to determine whether the evenness (i.e., the degree of evenness of the overall wafer; evenness decreases if the overall wafer brakes or the wafer warps toward the center portion or edge portion) of the wafer is the desired evenness. As a result, in the ultra-precision machining stage which focuses on making minute adjustments to the thickness and evenness, minute adjustments may occasionally not be sufficient.

DESCRIPTION OF THE INVENTION

In view of the foregoing problems, it is an object of this invention to provide a precision machining apparatus and precision machining method capable of both performing rough grinding through ultra-precision grinding consistently, and grinding a body to be ground to a highly precise thickness and evenness.

In order to achieve the foregoing object, a precision machining apparatus according to the invention which includes a first rotating device that rotates a grinding target body and a first mount that supports the first rotating device; a second rotating device that rotates a wheel and a second mount that supports the second rotating device; moving means for selectively moving the first mount and the second mount closer to one another or farther away from one another; controlling means for controlling the amount that the first and second mounts are moved by the moving means; and measuring means for measuring thickness and evenness of the grinding target body, is characterised in that the moving means includes a first moving portion formed of a feed-screw mechanism and a second moving portion formed of an actuator that is based on pressure control, the moving means moving the first mount and the second mount relative to one another by selectively using the first moving portion and the second moving portion as the situation demands, and the controlling means is structured to adjust the amount that the first and second mounts are moved based on measurement results obtained by the measuring means to obtain a predetermined thickness and evenness of the grinding target body.

This invention relates to a precision machining apparatus capable of grinding a grinding target body consistently from rough grinding to ultra-precision grinding using only a single precision machining apparatus. The invention relates to an apparatus for producing a finished grinding target body having a desired evenness and thickness, while appropriately controlling the evenness and thickness of the grinding target body in each grinding stage. Here, evenness refers to the degree of evenness of the entire grinding target body (such as a wafer). For example, depending on the grinding method and how far the grinding has progressed, the entire wafer may undulate and the center portion may warp, resulting in poor unevenness.

The first rotating device which rotates the grinding target body while holding it is mounted on the first mount, and the second rotating device which rotates the wheel is mounted on the second mount such that the machining surface of the grinding target body and the wheel surface face one another. Both are positioned such that the central axes of the grinding target body and the wheel are aligned with one another. Grinding is then performed while, for example, the first mount which supports the first rotating device that rotates the grinding target body is fixed and the amount of movement of the second mount which supports the second rotating body that rotates the wheel is controlled by the first moving portion or the second moving portion depending on the machining stage.

The first moving portion is a controlling mechanism that is based on the amount of movement that the second mount is physically moved. The second moving portion is a constant pressure control mechanism that moves the second mount by applying a constant pressure to it. In order to perform ultra-precision grinding efficiently, the second mount is preferably controlled in the initial rough grinding stage based on the amount of movement in the view of the grinding amount and grinding efficiency and the like, while finishing is preferably done by constant pressure control that changes in a stepped fashion in the final finishing stage (i.e., the ultra-precision grinding stage). Accordingly, this invention enables consistent grinding to be performed with a single apparatus as described above by providing a precision machining apparatus that has a first moving portion and a second moving portion.

In one example in which the second mount which supports the second rotating device that rotates the wheel is moved toward the grinding target body side, a nut and feed-screw which form a so-called feed-screw mechanism (i.e., the first moving portion) are attached to the second mount. Moreover, a suitable pneumatic actuator or hydraulic actuator (i.e., the second moving portion) is also attached to the second mount. The feed-screw mechanism is such that the nut is able to be screwed onto the feed-screw that is attached to an output shaft of the servo motor. The movement of the second mount is able to be controlled by having the nut be attached to the second mount. The feed-screw mechanism and actuator can be appropriately selected according to the grinding stage. For example, in the initial rough grinding stage, the feed-screw mechanism is selected and rough grinding is performed on the surface of the grinding target body until the grinding target surface is ground to a certain roughness by moving the rotating device (i.e., the wheel) on the second mount toward the grinding target body side by moving the nut an appropriate amount. When rough grinding of the surface of the grinding target body is finished, the control mode switches from control based on the movement amount to constant pressure control in the ultra-precision grinding stage. When switching to this control mode, the wheel used is replaced with a wheel for ultra-precision grinding. In the ultra-precision grinding stage, the finishing of the surface of the grinding target body is done by extremely fine grinding. This grinding requires that the wheel be pressed against the surface of the grinding target body at a constant pressure. Therefore, this invention aims to realize this constant pressure control by using a pneumatic actuator or a hydraulic actuator, for example.

The precision machining apparatus of this invention makes it possible to perform consistent grinding from rough grinding to ultra-precision grinding all with only a single precision machining apparatus because it is possible to selectively use the feed-screw mechanism and the pneumatic or hydraulic actuator. Also, in the ultra-precision grinding stage which requires constant pressure control, a well-known pneumatic or hydraulic actuator can be used. As a result, no problems of heat generation or the like occur during operation of the actuator and the apparatus is able to be manufactured inexpensively.

In the final ultra-precision grinding stage, the evenness and thickness of the grinding target body are both finely adjusted. Therefore in the rough grinding stage up to this ultra-precision grinding stage, grinding control must be performed so that the evenness of the grinding target body becomes a suitable evenness and the thickness of the grinding target body becomes a suitable thickness. In this invention, appropriate measuring means is used to measure the evenness and thickness of the grinding target body in each grinding stage and a movement amount command based on the measurement results is fed back via suitable controlling means to the first moving portion or the second moving portion depending on the grinding stage such that the desired finished grinding target body is able to be produced. For example, the evenness and thickness of the grinding target body at an arbitrary point in a grinding stage is set in advance and the data from the rough grinding stage through the ultra-precision grinding stage is stored in controlling means housed in a computer. The measurement results from the measuring means at the arbitrary point are sent to the controlling means which then obtains the difference between the preset data (i.e., target values) and the measured data. A movement amount command is then sent to the first moving portion or the second moving portion that will execute the next grinding process to reduce that difference, and the moving portion then moves based on that command value.

Further, although the measuring means is not particularly limited, it is desirable that non-contact type measuring means be used in order to prevent chipping of the grinding target body surface and damage to the grinding target body. In particular, the grinding target body that is to be ground by the precision machining apparatus of this invention is extremely thin, which means that it is necessary to avoid having the measuring means measure the surface evenness by scanning the surface of the grinding target body or the like. Therefore, an optical probe for realizing near-field optical reflection measurements is one example that can be used as the measuring means. The thickness and surface evenness at arbitrary locations on the grinding target body are measured by arranging one or a plurality of these optical probes in opposing positions near the grinding target body. In this case, an electron beam or a laser beam is irradiated on the grinding target body from the optical probe. For example, when the grinding target body is a silicon wafer, the silicon wafer has a property wherein ultraviolet rays are able to pass through the inside of the silicon wafer while visible rays, which have longer wavelengths than ultraviolet rays, do not pass through but are instead reflected by the surface. Therefore, when measuring the thickness of a silicon wafer, a visible ray and an ultraviolet ray are irradiated separately at the same point on the silicon wafer. The thickness of the wafer can then be measured with extreme accuracy from the difference in the reflected light of both the visible ray and the ultraviolet ray. Meanwhile, when measuring the evenness of the silicon wafer, the evenness of the entire wafer can be measured by irradiating only a visible ray and taking the measurement from the light speed of the visible ray and the time that it takes between irradiation, reflection, and reception of the reflected light. Here, the thickness measuring optical probe and the evenness measuring optical probe may be the same probe or separate probes. Also, depending on the material of the grinding target body, there may be a need to appropriately adjust the type of light wave irradiated (i.e., use a visible ray and an infrared ray; use an infrared ray and a microwave, or the like). Further, one example of a method for measuring multiple points on the surface of the grinding target body is as follows. That is, when the radius of the grinding target body is denoted by the reference character r, multiple points on the surface of the grinding target body can be measured by measuring multiple points at an arbitrary radius r1 on the grinding target body by rotating the grinding target body once, sliding the grinding target body horizontally in the plane along which the grinding target body is held by the rotating device, measuring multiple points at a radius r2 which is different from the radius r1 in the same fashion, and repeating this operation multiple times within the radius.

Also, a precision machining apparatus according to another aspect of the invention relates to a precision machining apparatus which includes a first rotating device that rotates a grinding target body and a first mount that supports the first rotating device; a second rotating device that rotates a wheel and a second mount that supports the second rotating device; moving means for selectively moving the first mount and the second mount closer to one another or farther away from one another; controlling means for controlling the amount that the first and second mounts are moved by the moving means; and measuring means for measuring thickness and evenness of the grinding target body. This precision machining apparatus is characterised in that the moving means includes a first moving portion formed of a feed-screw mechanism and a second moving portion formed of an actuator that is based on pressure control, and moves the first mount and the second mount relative to one another by selectively using the first moving portion and the second moving portion as the situation demands; a posture control device for controlling the posture of the first or second rotating devices is interposed between the first rotating device and the first mount or between the second rotating device and the second mount; the posture control device includes a first plate member which extends in a plane formed of an X axis and a Y axis and a second plate member which is parallel to and distanced from the first plate member; concave portions are formed in opposing surfaces of the two plate members; a spherical body is interposed between the first plate member and the second plate member, with portions of the spherical body fit into the two concave portions; a first actuator which expands in the direction of a Z axis that extends perpendicular to the plane formed of the X axis and the Y axis is also interposed between the first plate member and the second plate member; a second actuator which expands in an appropriate direction in the plane formed of the X axis and the Y axis is connected to the second plate member; the second plate member is structured to be able to move relative to the first plate member while an object is placed on the second plate member; the spherical body is attached to the first plate member and/or the second plate member by an adhesive which is able to elastically deform; a piezoelectric element and a super magnetostrictive element are provided on both the first actuator and the second actuator; and the controlling means is structured such that the amount that the first and second mounts are moved and/or the posture of the posture controlling apparatus is adjusted based on the measurement results obtained by the measuring means to obtain the predetermined thickness and evenness of the grinding target body.

The first plate member and the second plate member are both made of material that has sufficient strength to be able to support the weight of an object placed on the second plate member and are preferably made of non-magnetic material. The material is not particularly limited but austenite stainless steel (SUS) can be used. Meanwhile, the spherical body interposed between the first plate member and the second plate member similarly must be made from material having sufficient strength to be able to support at least the weight of an object is placed on the second plate member. Therefore, the material of which the spherical body is formed can be appropriately selected according to the set weight of the object, but metal is one example that can be used. Concave portions corresponding to the shape of the spherical body are formed in locations in the first plate member and the second plate member corresponding to the spherical body. The spherical body is arranged interposed between the plate members, with portions of the spherical body fit into both of the concave portions. The dimensions of these concave portions (i.e., the depth and opening diameter and the like) can be appropriately adjusted according to the size of the plate members and the spherical body, the required posture control precision, and the like. Naturally, at least a predetermined clearance between the first plate member and the second plate member must be maintained by the portions of the spherical body being fit into the concave portions. This clearance is an appropriate clearance that ensures that the second plate member will not contact the first plate member even if the second plate member tilts by the second actuator being operated, for example.

The spherical body and the surfaces of the concave portions formed in opposing locations in the two plate members can be connected with an adhesive. The adhesive used can be a suitable adhesive of a material having elastic performance at normal temperature. Some examples that can be used include an elastic epoxy-based adhesive and an elastic adhesive. For example, an adhesive can be used in which the tensile shearing adhesion strength is 10 to 15 Mpa, the attenuation coefficient is 2 to 7 Mpa-sec, more preferably 4.5 Mpa-sec, and the spring coefficient of the adhesive is 80 to 130 GN/m, more preferably 100 GN/m. The thickness of the adhesive can be set to approximately 0.2 mm. Instead of having the concave portions formed in both plate members, a concave portion may be formed in only one of the plate members, a portion of the spherical body fit into this concave portion, and the spherical body adhered to the surface of the concave portion with an adhesive.

One example of the posture control device involves arranging the spherical body and two first actuators between the first plate member and the second plate member so that they are each in positions at apexes of an arbitrary planar triangle, and the second actuator is mounted on at least one of the four end sides of the second plate member. These three actuators make is possible to realize three-dimensional displacement of the second plate member with respect to the first plate member while an object is placed directly on the second plate member. When the second plate member is displaced, the adhesive of the surface of the spherical body that supports the second plate member from below elastically deforms, which enables free displacement of the second plate member with almost no binding.

Both the first and second actuators are preferably actuators that are provided with at least a super magnetostrictive element. Here, a super magnetostrictive element is formed from an alloy of nickel or iron and a rare-earth metal such as dysprosium or terbium. The element is able to expand approximately 1 μm to 2 μm by a magnetic field generated when current is applied to a coil around a rod-shaped super magnetostrictive element. Also, this super magnetostrictive element has properties such that it can be used in a frequency range of equal to or less than 2 kHz and has a picosecond ($10^{-12}$ sec) response speed. Furthermore, the output performance is approximately 5 kJ/cm$^3$, which is an output performance approximately 20 to 50 times that of a piezoelectric element to be described later. Meanwhile, the piezoelectric element can be formed from lead titanate (PbTiO3), barium titanate (BaTiO3), or lead zirconate titanate (Pb (Zr, Ti) O3) or the like. The piezoelectric element has properties such that it can be used in a frequency range of equal to or greater than 10 kHz and has a nanosecond ($10^{-9}$ sec) response speed. The output power is less than that of the super magnetostrictive element, making it suitable for accurate positioning control (i.e., posture control) in a relatively light load region. Here, piezoelectric elements also include electrostrictive elements. Also, the moving amount command for the posture control device described above dictates the amount that the super magnetostrictive element and the piezoelectric element expand.

A coating of the adhesive is formed on the surface of the spherical body. The structure may be such that the spherical body and the coating of the adhesive are not attached to each other so they are able to move relative to one another. The adhesive is of a material that can elastically deform, as described above. For example, a coating of this adhesive can be formed on the surface of a metal spherical body. Here, in order to reduce the degree of binding with respect to movement of the second plate member, the spherical body and the adhesive on the outer periphery of the spherical body are not attached to each other in this invention. For example, a graphite coating may be formed on the surface of the spherical body and a coating of adhesive then formed on the outer periphery of this graphite coating. Because the adhesive and the graphite coating do not adhere to each other, i.e., because the two are essentially not attached to one another, when the second plate member is displaced, the spherical body rotates in a fixed position without binding, while the adhesive of the surface layer elastically deforms along with the displacement of the second plate member without binding from the spherical body. This part of the invention thus includes a plate member, an adhesive, and a spherical body (i.e., the surface coating thereof) suitable for realizing the first plate member, the adhesive attached to the first plate member, and the spherical body (or the coating on the surface of the spherical body) not attached to the adhesive, respectively. The extremely small and real-time movements required of the posture control device can be realized by further reducing the degree of binding with respect to movement of the second plate member. Moreover, because there is almost no binding of the second plate member, the energy required of the second actuator when it is used to displace the second plate member can be reduced compared to related art.

The invention also relates to a precision machining apparatus capable of suitably controlling not only a first moving portion and a second moving portion, but also a posture control device, in the grinding stages, or a precision machining apparatus capable of suitably controlling on the posture control device. In particular, in the grinding stages, when controlling only the posture control device, the second plate member that forms the posture control device can be moved to a suitable position and a suitable angle (i.e., posture control) by sending a moving amount command (i.e., an expansion/contraction amount command of the super magnetostrictive element or the like) to the first actuator and/or the second actuator based on measurement results from the measuring means. Providing a structure in which a feedback command is only sent to the posture control device and not to the moving portion obviates the need to provide an interface circuit that connects the moving portion with the posture control device, thus enabling the circuit configuration of the control to be simplified.

According to the invention, the super magnetostrictive element and the piezoelectric element of each actuator are able to be selected appropriately according to the weight of the object placed on the second plate member and the grinding stage. Therefore, grinding can be performed while performing extremely accurate posture control of the rotating device, while dramatically reducing the effects from heat generation when only the super magnetostrictive element is used. Grinding is performed while using the posture control device to suitably correct misalignment of the axial centers of the opposing rotating devices. Because the response speed of both the super magnetostrictive element and the piezoelectric element are fast, in this invention both the super magnetostrictive element and the piezoelectric element are used selectively, with the piezoelectric element being used as the principal element and the super magnetostrictive element being used as needed. Minute misalignments of the axial centers are constantly being detected. These detected minute misalignments undergo numerical machining by a computer and are input to the actuators as amounts that the super magnetostrictive element (i.e., super magnetostrictive actuator) or the piezoelectric element (i.e., piezoelectric actuator) needs to be expanded or contracted.

Also, in the precision machining apparatus according to the invention, the second moving portion may also include a plurality of pneumatic actuators or hydraulic actuators of different pressure performances, and the movement of the second mount and the second rotating device by the second moving portion can be selectively controlled by different pressures.

In the ultra-precision grinding stage until the final finishing stage, constant pressure grinding in multiple stages must be performed while gradually reducing the pressure and adjusting the surface of the grinding target body so that it is in the ductility mode.

In this invention, the constant pressure grinding in multiple stages is performed by an actuator having a pressure performance that corresponds to each constant pressure grinding stage. For example, when pressure control of 10 mgf/cm$^2$ to 5000 gf/cm$^2$ is required, it is divided into two stages, with 10 mgf/cm$^2$ to 300 gf/cm$^2$ being a low pressure region and 300 gf/cm$^2$ to 5000 gf/cm$^2$ being a high pressure region. Two types of actuators, on which is used in one pressure region and the other which is used in the other pressure region, can then be selectively mounted.

Also, in the precision machining apparatus according to the invention, the wheel may also include at least CMG wheel.

CMG wheel (fixed abrasive coating) is a wheel that is used during final grinding according to the CMG (Chemo Mechanical Grinding) method. This method performs only a grinding process that employs a CMG wheel, instead of many of the conventional processes such as etching, rubbing, and polishing. It is a technology for which development is currently progressing. In the grinding process, a diamond wheel is used in the rough grinding stage while a CMG wheel is used in the ultra-precision grinding stage, that is, different types of wheels are used depending on the grinding stage.

Also, a precision machining method according to the invention uses a precision machining apparatus which includes a first rotating device that rotates a grinding target body and a first mount that supports the first rotating device; a second rotating device that rotates a wheel and a second mount that supports the second rotating device; moving means for selectively moving the first mount and the second mount closer to one another or farther away from one another; controlling means for controlling the amount that the first and second mounts are moved by the moving means; and measuring means for measuring thickness and evenness of the grinding target body, the moving means including a first moving portion formed of a feed-screw mechanism and a second moving portion formed of an actuator that is based on pressure control. This precision machining method is characterised by including a first process of grinding the grinding target body by rough grinding the grinding target body, and a second process of finishing the grinding target body by grinding the ground grinding target body with a CMG wheel, wherein in the first process, the movement of the first and second rotating devices and the first and second mounts is adjusted using the first moving portion, and in the second process, movement of the first and second rotating devices and the first and second mounts is adjusted using the second moving portion, and further, in the first process and the second process, the thickness and evenness of the grinding target body that was ground is measured by the measuring means and the amount that the first and second mounts are moved is adjusted based on the obtained measuring results to obtain a predetermined thickness and evenness of the grinding target body.

For example, in the first process, rough grinding is performed with a diamond wheel and in the second process, ultra-precision grinding is performed with a CMG wheel.

The first moving portion that performs the first process is a control mechanism that performs rough grinding by physically moving the second mount a fixed amount toward the first mount side using, for example, a feed-screw mechanism or the like, as described above.

The second moving portion that performs the second process is a mechanism that performs constant pressure control in a stepped manner, as described above, and can be realized by selecting an appropriate pneumatic actuator or hydraulic actuator for each pressure stage. As described above, the desired finished grinding target body is able to be produced by measuring the thickness and evenness of the surface of the grinding target body using suitable measuring means in each of the grinding stages (i.e., in the first and second processes) and feeding back, via suitable controlling means, an adjustment portion moving amount command based on the measurement results to either the first moving portion or the second moving portion depending on the grinding stage.

Further, another aspect of the invention relates to a precision machining method using a precision machining apparatus which includes a first rotating device that rotates a grinding target body and a first mount that supports the first rotating device; a second rotating device that rotates a wheel and a second mount that supports the second rotating device; moving means for selectively moving the first mount and the second mount closer to one another or farther away from one another; controlling means for controlling the amount that the first and second mounts are moved by the moving means; measuring means for measuring thickness and evenness of the grinding target body; and a posture control device for controlling the posture of the first or second rotating devices, which is interposed between the first rotating device and the first mount or between the second rotating device and the second mount, the moving means including a first moving portion formed of a feed-screw mechanism and a second moving portion formed of an actuator that is based on pressure control. This precision machining method is characterised by including a first process of grinding the grinding target body by rough grinding the grinding target body, and a second process of finishing the grinding target body by grinding the ground grinding target body with a CMG wheel. Further, in the first process, the movement of the first and second rotating devices and the first and second mounts is adjusted using the first moving portion and rough grinding the grinding target body, and in the second process, the movement of the first and second rotating devices and the first and second mounts is adjusted using the second moving portion. Moreover, in the first process and the second process, the thickness and evenness of the grinding target body that was ground is measured by the measuring means and the amount that the first and second mounts are moved and/or the posture of the posture control device is adjusted based on the obtained measuring results to obtain a predetermined thickness and evenness of the grinding target body.

The invention relates to not only to a method of controlling the first moving portion and the second moving portion, but also to a method of controlling the posture control device or to a method for controlling only the posture control device. In particular, the invention is advantageous in that it not only obviates the need for an interface circuit between the first and second moving portions and the posture control device when only the posture control device is controlled, as described above, but also enables a high quality finished grinding target body to be produced by operating only the posture control of the posture control device.

Further, in the precision machining method according to the invention, the transition from the first process to the second process may be made without unchucking the grinding target body, which is chucked to the rotating device, from the rotating device.

The grinding target body may be chucked according to an appropriate method such as vacuum suction or the like. Upon examination, however, the inventors found that when a grinding target body was unchucked during the transition from grinding with the diamond wheel (i.e., the first process) to grinding with the CMG wheel (i.e., the second process), a mottling pattern remained on the ground grinding target body surface produced in the first process. On the other hand, no mottling pattern was found when the grinding target body was not unchucked during that transition. It can therefore be determined that the grinding target body warps during unchucking due to residual stress generated in the diamond grinding stage, and this warping produces a mottling pattern on the surface.

As can be understood from the foregoing description, the precision machining apparatus and precision machining method according the invention are able to realize both efficient and accurate grinding because they enable grinding from rough grinding through ultra-precision grinding to be performed consistently while selectively employing control based on the moving amount by the first moving portion such as a feed-screw mechanism and multi-stepped constant pressure control by the second moving portion such as a pneumatic actuator or hydraulic actuator. The precision machining apparatus of this invention also enables increased grinding precision because the posture control apparatus in which a spherical body is interposed between two plate members appropriately corrects the posture of the rotating device during grinding. Here, the precision machining apparatus according to the invention is not structured to perform pressure control in the ultra-precision grinding stage using a super magnetostrictive actuator so there is no need to take into consideration the problem of heat generation in that grinding stage. Furthermore, the precision machining apparatus and precision machining method according to the invention make it possible to produce a finished product which is a precisely ground grinding target body by proceeding with grinding while appropriately measuring and controlling the evenness and thickness of the grinding target body and performing feedback control as necessary throughout all of the grinding stages from rough grinding to ultra-precision grinding.

BRIEF DESCRIPTION OF THE DRAWINGS

The features, advantages thereof, and technical and industrial significance of this invention will be better understood by reading the following detailed description of preferred embodiments of the invention, when considered in connection with the accompanying drawings, in which.

DETAILED DESCRIPTION OP THE PREFERRED EMBODIMENTS

Figure 1:
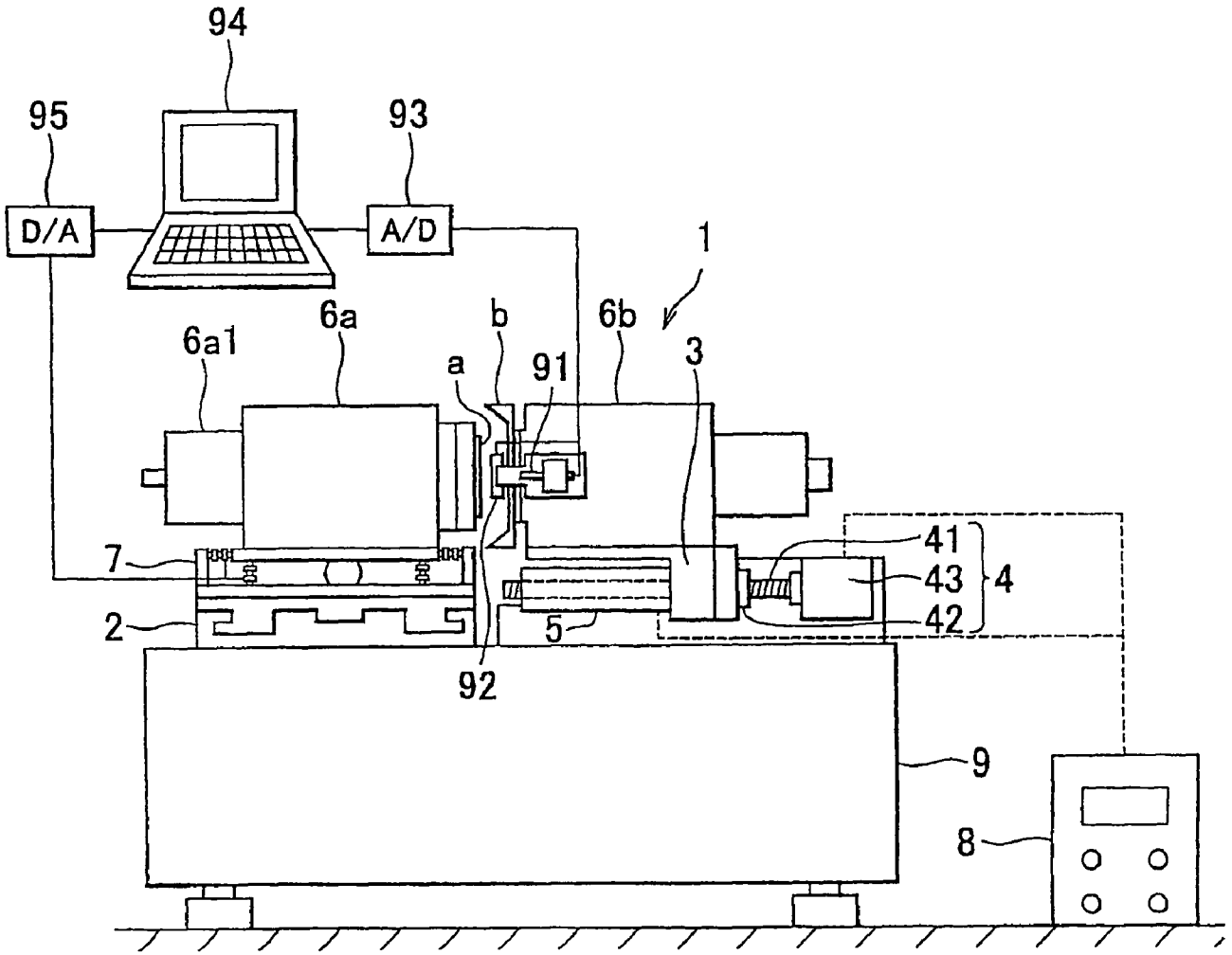
FIG. 1 is a side view of a precision machining apparatus according to one exemplary embodiment of the invention.

In the following description and the accompanying drawings, the present invention will be described in more detail in terms of exemplary embodiments. A pneumatic actuator is used in the exemplary embodiment shown in the drawings. Alternatively, however, a hydraulic actuator may be used. Further, three or more actuators may be provided depending on the pressure control. Moreover, in the exemplary embodiment shown in the drawings, the posture control device is feedback controlled. Of course, alternatively, a feed-screw mechanism may be feedback controlled or both the posture control device and the feed-screw mechanism may be controlled by an interface circuit.

FIG. 1 shows a precision machining apparatus 1 according to one exemplary embodiment. The precision machining apparatus 1 largely includes a rotating device 6*a* which rotates a grinding target body a in a vacuum suctioned posture, a first mount 2 that supports the rotating device 6*a*, a second mount 3 that supports a rotating device 6*b* that rotates a wheel b, moving means for moving the second mount 3 in the horizontal direction, and a base 9 that supports the first mount 2 and the second mount 3 from underneath. For the wheel b, a diamond wheel is preferably used in the rough grinding stage and a CMG wheel is preferably used in the ultra-precision grinding stage.

A posture control device 7 is interposed between the first mount 2 and the rotating device 6*a*. Also, the moving means includes a feed-screw mechanism 4 for controlling the second mount 3 based on the moving amount and a pneumatic actuator 5 for pressure-controlling the second mount 3. The feed-screw mechanism 4 and the pneumatic actuator 5 are both connected to a controller 8 and are structured so that they can be switched appropriately depending on the grinding stage.

The feed-screw mechanism 4 is structured such that a nut 42 which is attached to the second mount 3 can be rotatably screwed onto a feed-screw 41 that is mounted to an output shaft of a servo motor 43. The nut 42 and the second mount 3 are structured so that they can be detached from one another. An optical probe 91 for measuring the thickness of the grinding target body (hereinafter also referred to as "thickness measuring optical probe 91") and an optical probe 92 for measuring the evenness of the grinding target body (hereinafter also referred to as "evenness measuring optical probe 92") are both mounted, in a position so as not to interfere with the rotation of the wheel b, to the surface of the rotating device 6*b* that opposes the grinding target body a which is mounted to the rotating device 6*a*. These optical probes 91 and 92 are suitable for use with the precision machining apparatus of this invention which produces ultra thin wafers and the like because they can measure the thickness and evenness of the grinding target body a without contacting the grinding target body a. An encoder (a rotary encoder 6*a*1) is fixed to the rear of the rotating device 6*a* and is structured such that the thickness and evenness of the grinding target body a that are measured by the optical probes 91 and 92 are consecutively recorded at arbitrary positions (r) in the radial direction and at each angle (θ) when the grinding target body a rotates 360 degrees, which is read by the encoder (to be described later). The measurement results (i.e., the thickness and evenness of the grinding target body) measured by the optical probes 91 and 92 are then sent to a computer 94 via an A/D converter 93. In the computer 94, the amount that the rotating device 6*b* is moved from rough grinding to ultra-precision grinding, for example, as well as the thickness and evenness of the grinding target body at each grinding stage, is set and recorded in advance. Controlling means which is housed separately closely checks the difference between the measurement results by the optical probes 91 and 92 and the set values, and determines whether that difference is within an allowable range. If that difference is outside of the allowable range, the controlling means outputs a feedback command to the posture control device 7 (the feedback command is sent from the computer 94 to the first actuator or the second actuator of the posture control device 7 via a D/A converter 95) to control the posture of the grinding target body a.

Figure 2:
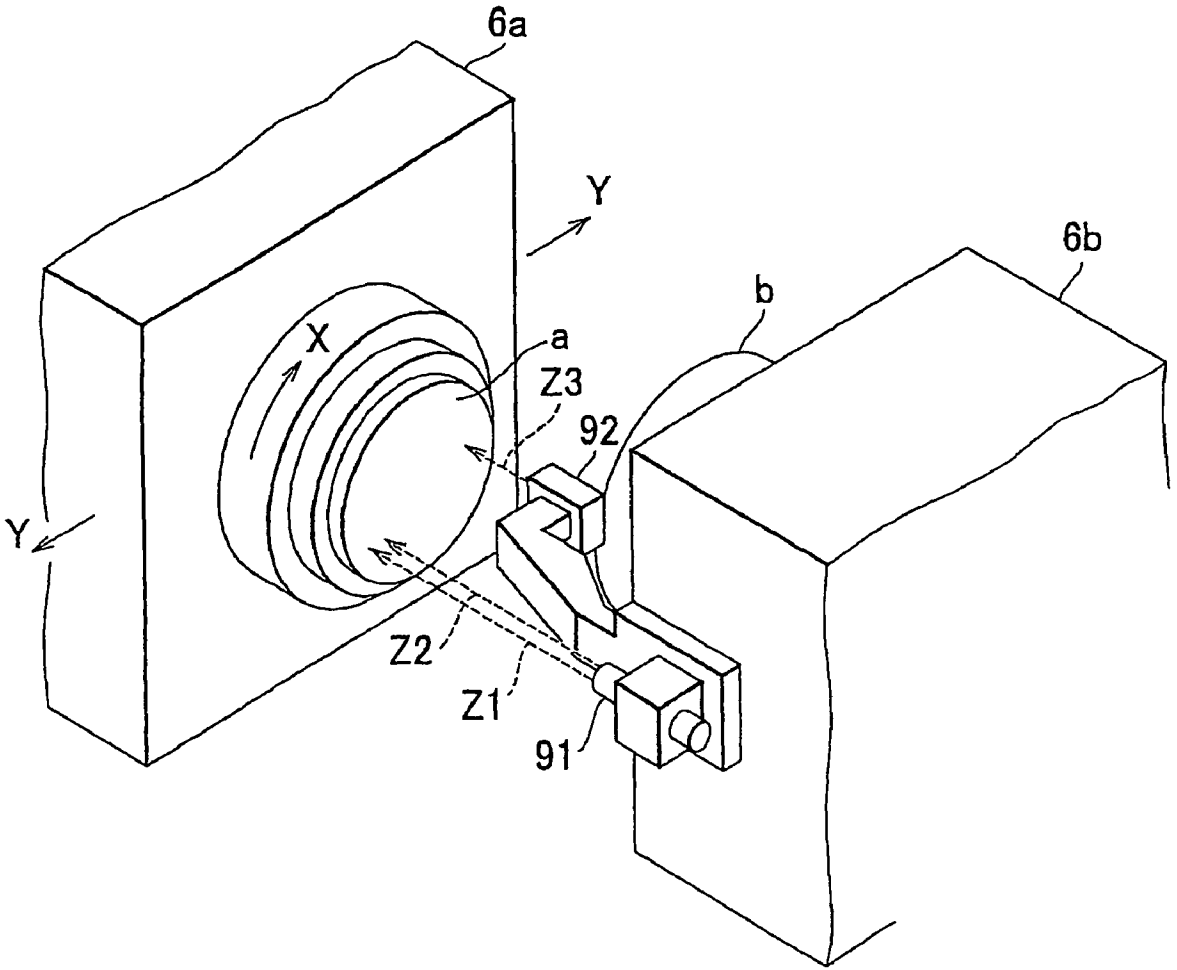
FIG. 2 is a view showing a frame format of a light beam being illuminated from an optical probe onto a grinding target body.

FIG. 2 is a view showing a frame format of a light beam being illuminated from an optical probe onto the grinding target body. When the grinding target body a is a silicon wafer, the thickness measuring optical probe 91 irradiates two light waves of different wave lengths (i.e., an ultraviolet ray Z1 and a visible ray Z2) and measures the thickness based on the reflected light of these two rays (to be described later). Meanwhile, the evenness measuring optical probe 92 irradiates a visible ray Z3 and measures the evenness based on the reflected light thereof (to be described later). Also, the thickness measuring optical probe 91 and the evenness measuring optical probe 92 measure values at arbitrary points within the radius of the grinding target body a. The grinding target body a is rotated (i.e., in direction X) by the rotating device 6*a* so multiple measurement results at this arbitrary radius can be obtained by taking multiple measurements in the circumferential direction at this arbitrary radius. In this case, measurements can be taken at multiple points in the circumferential direction at separate radii by moving the grinding target body a in the horizontal direction (i.e., in direction Y) at the side surface of the rotating device 6*a*. Measurements can be taken at multiple points across the entire surface of the grinding target body a by gradually sliding the grinding target body a from the center point to the outer peripheral edge of the grinding target body a while rotating it.

Figure 3:
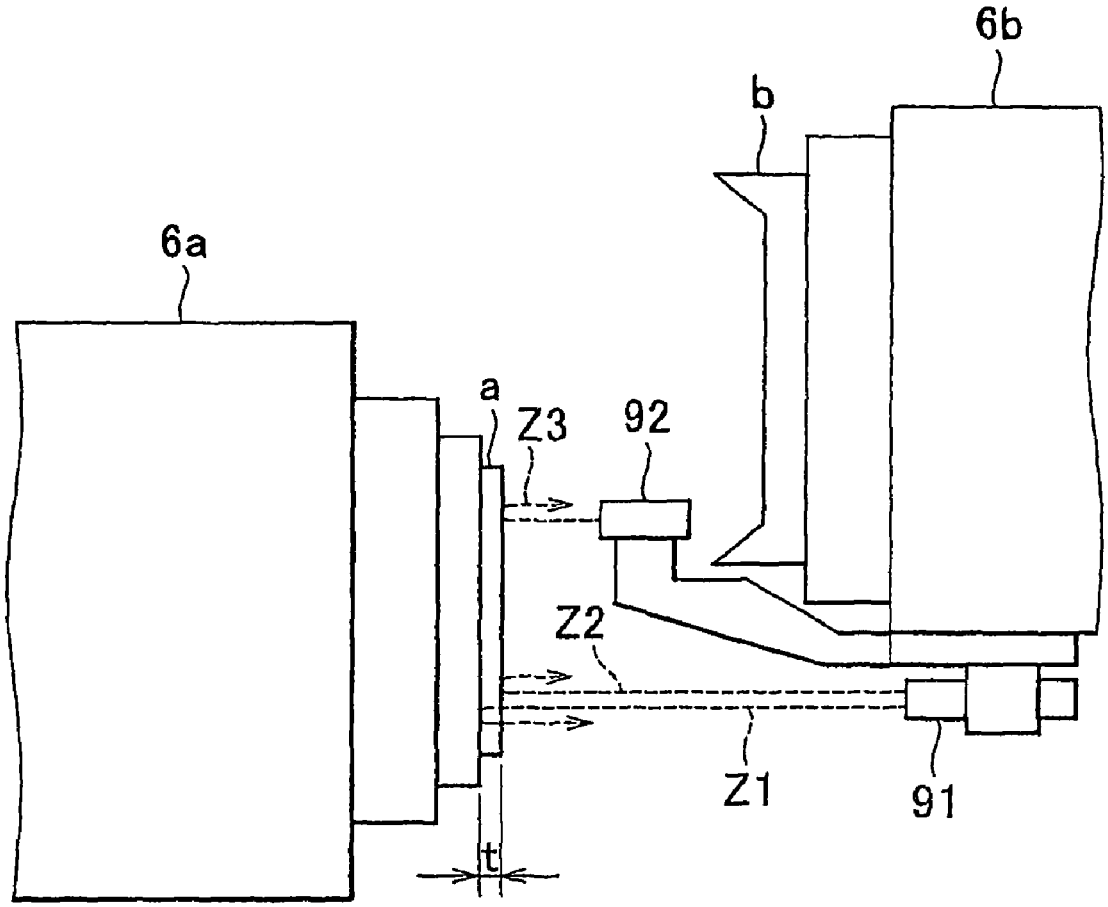
FIG. 3 is a view showing a frame format of a measurement being taken of the evenness of the grinding target body and a measurement being taken of the thickness of the grinding target body.

FIG. 3 shows measurements being taken of the thickness and evenness of the grinding target body a (in this case a silicon wafer) by the thickness measuring optical probe 91 and the evenness measuring optical probe 92. The thickness measuring optical probe 91 irradiates the ultraviolet ray Z1 having a wavelength that passes through the silicon wafer and the visible ray Z2 that does not pass through the silicon wafer but is reflected by its surface. The thickness of the silicon wafer is able to be precisely measured by reading the reflected light of both rays with the thickness measuring optical probe 91.

Meanwhile, the evenness measuring optical probe 92 irradiates only the visible ray Z3. Irradiating the visible ray Z3 across an arbitrary diameter of the silicon wafer, for example, enables the evenness across that diameter to be precisely measured. That is, the evenness of the entire wafer can be measured from the light speed of the visible ray and the time that it takes between irradiation, reflection, and reception of the reflected light. In the exemplary embodiment shown in the drawing, the thickness measuring optical probe and the evenness measuring optical probe are two separate probes. Alternatively, however, the thickness and evenness may both be measured by a single optical probe.

Figure 4:
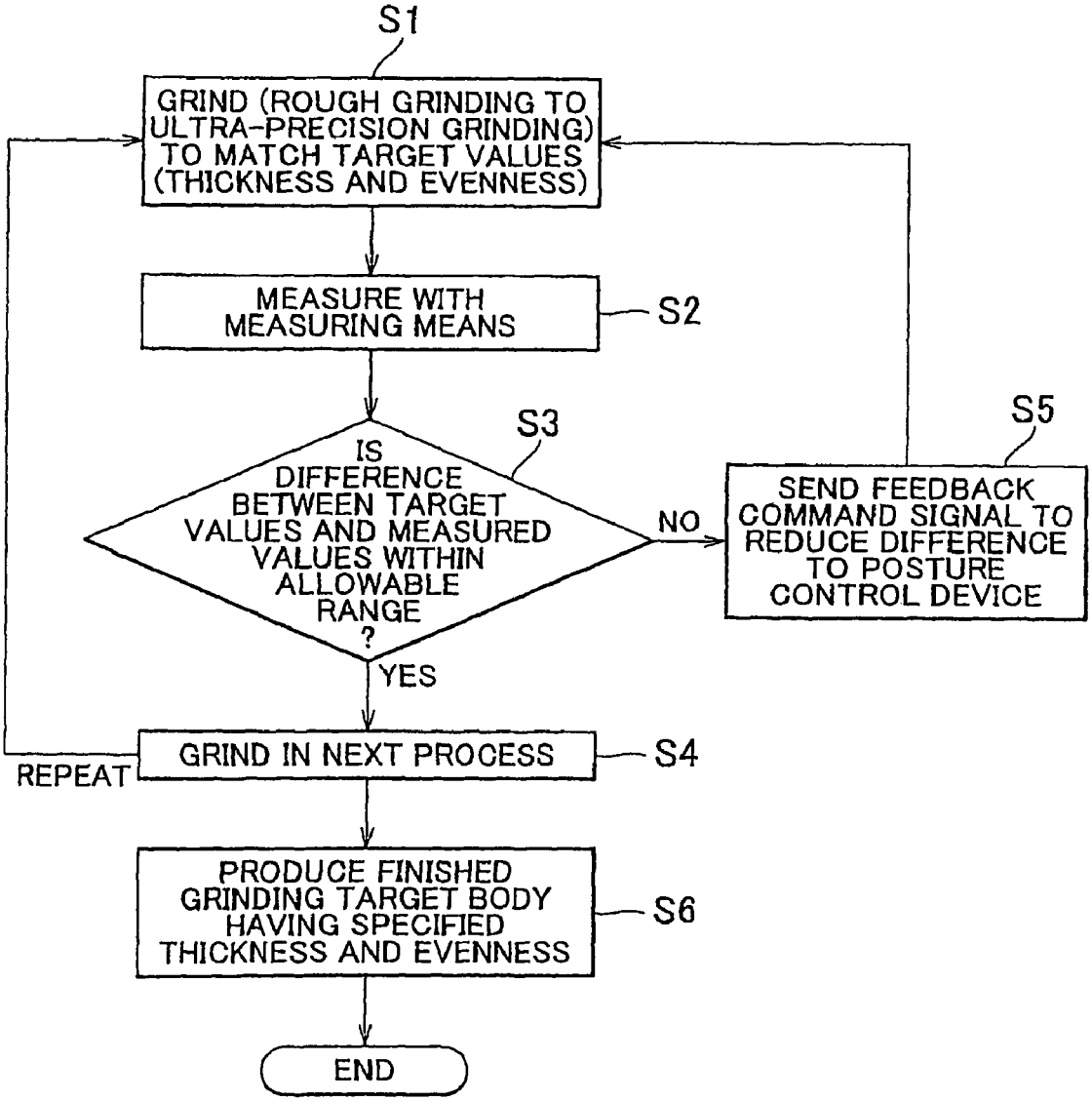
FIG. 4 is a flowchart illustrating a feedback control of a posture control device.

FIG. 4 is a flowchart illustrating feedback control of the posture control device. The grinding target body a is ground while driving the feed-screw mechanism 4 so as to obtain a preset target value for both the evenness and thickness of the grinding target body at an arbitrary point and at each stage from rough grinding to ultra-precision grinding (step S1). In this grinding stage, the surface evenness of the grinding target body a and the thickness of the grinding target body a are measured by measuring means (i.e., an optical probe) (step S2).

It is then determined whether the measurement results from the measuring means are within an allowable range of target values relating to evenness and thickness (step S3). If the measurement results are within the allowable range, the grinding process continues (step S4). If, on the other hand, the measurement results are outside of the allowable range, a feedback command signal to reduce the difference between the measurement results and the target values is sent to the posture control device 7 (step S5). Steps S1 to S5 are continuously performed at all stages from rough grinding to ultra-precision grinding. The routine ends when the finished product has a specified evenness and thickness (step S6).

Figure 5:
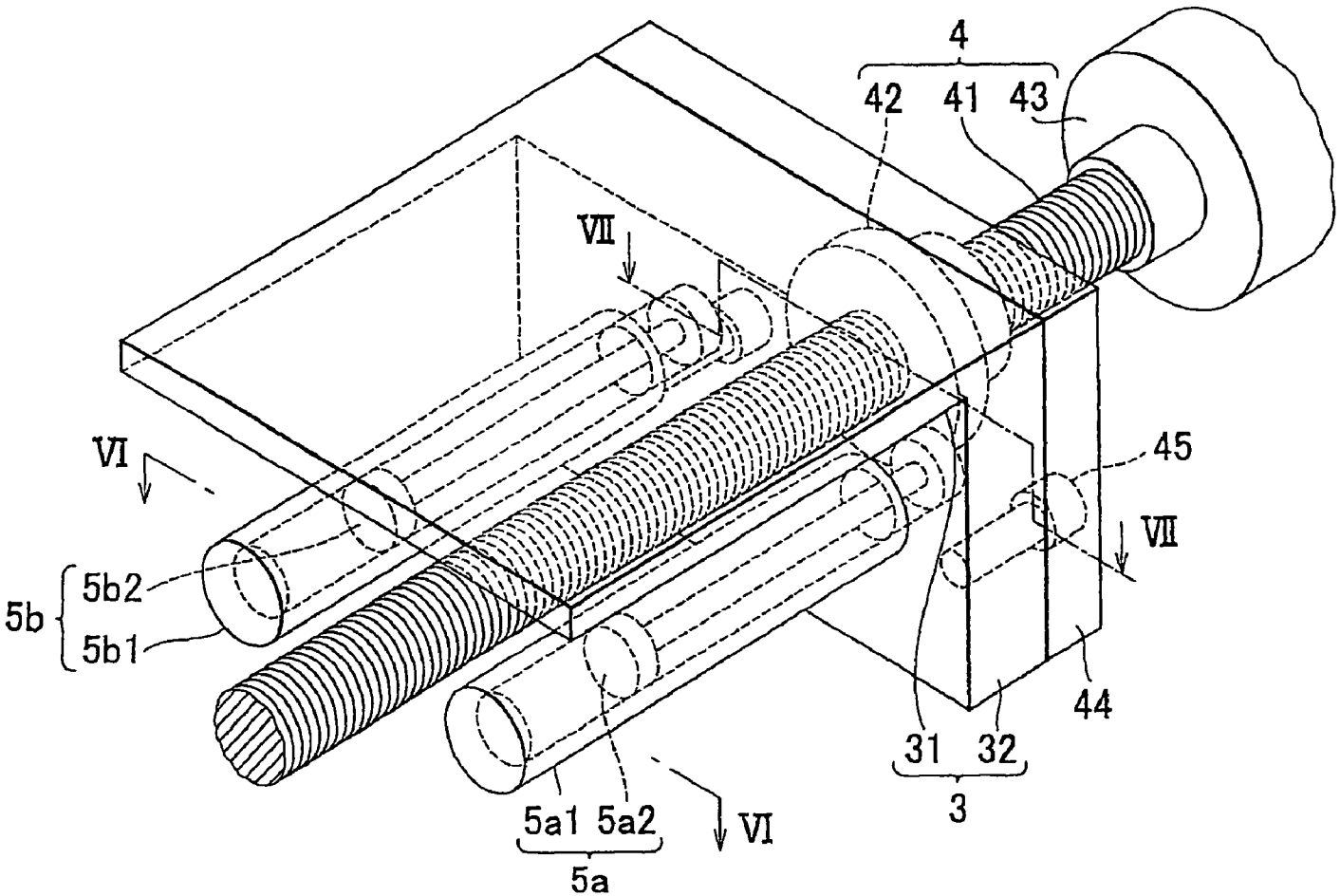
FIG. 5 is a perspective view of moving means.

FIG. 5 is a view showing the moving means in detail. The second mount 3 is shaped like the letter L when viewed from the side. One of the sides is the side on which the rotating device 6*b* is mounted, while the other side is the side that is joined via a pin member 45 with a plate member 44 to which the nut 42 that forms the feed-screw mechanism 4 is directly attached.

A through-hole into which the feed-screw 41 is loosely inserted is formed in the other side 32 of the second mount 3. Pneumatic actuators 5*a* and 5*b* are fixed to the left and right of the loosely fit feed-screw 41. These pneumatic actuators 5*a* and 5*b* have different pressure performances. For example, the pneumatic actuator 5*a* is an actuator that covers a relatively low pressure region while the pneumatic actuator 5*b* is an actuator that covers a relatively high pressure region. For example, in the pneumatic actuator 5*a*, a piston rod 5*a*2 is slidably housed in a cylinder 5*a*1. In this case, the actuators 5*a* and 5*b* do not necessarily have to be pneumatic actuators, but may be hydraulic actuators instead.

In the initial rough grinding stage of the grinding process, the plate member 44 that is connected to the nut 42 is connected to the second mount 3 by the pin member 45. Accordingly, the nut 42 moves a fixed amount according to the driving of the servo motor 43 and the second mount 3 (which is mounted to the rotating member 6*b*) is also able to be moved a fixed amount according to the movement of the nut 42.

Meanwhile, during the ultra-precision grinding stage after the rough grinding, the plate member 44 is disconnected from the second mount 3 by removing the pin member 45. In this state, the pneumatic actuator 5*b* that covers the high pressure region is now driven. The second mount 3 is pressed toward the first mount 2 side while one end of the piston rod 5*b*2 that forms the pneumatic actuator 5*b* pushes the plate member 44, i.e., while the plate member 44 receives the reaction force. This plate member 44 is fixed to the nut 42 and the nut 42 is screwed onto the feed-screw 41 so enough reaction force can be received to push the second mount 3. In the ultra-precision grinding process, after constant pressure grinding in steps has been performed in the high pressure region, the actuator used switches to the pneumatic actuator 5*a* that covers the low pressure region and constant pressure grinding in steps is performed in the low pressure region just as in was in the high pressure region.

Figure 6:
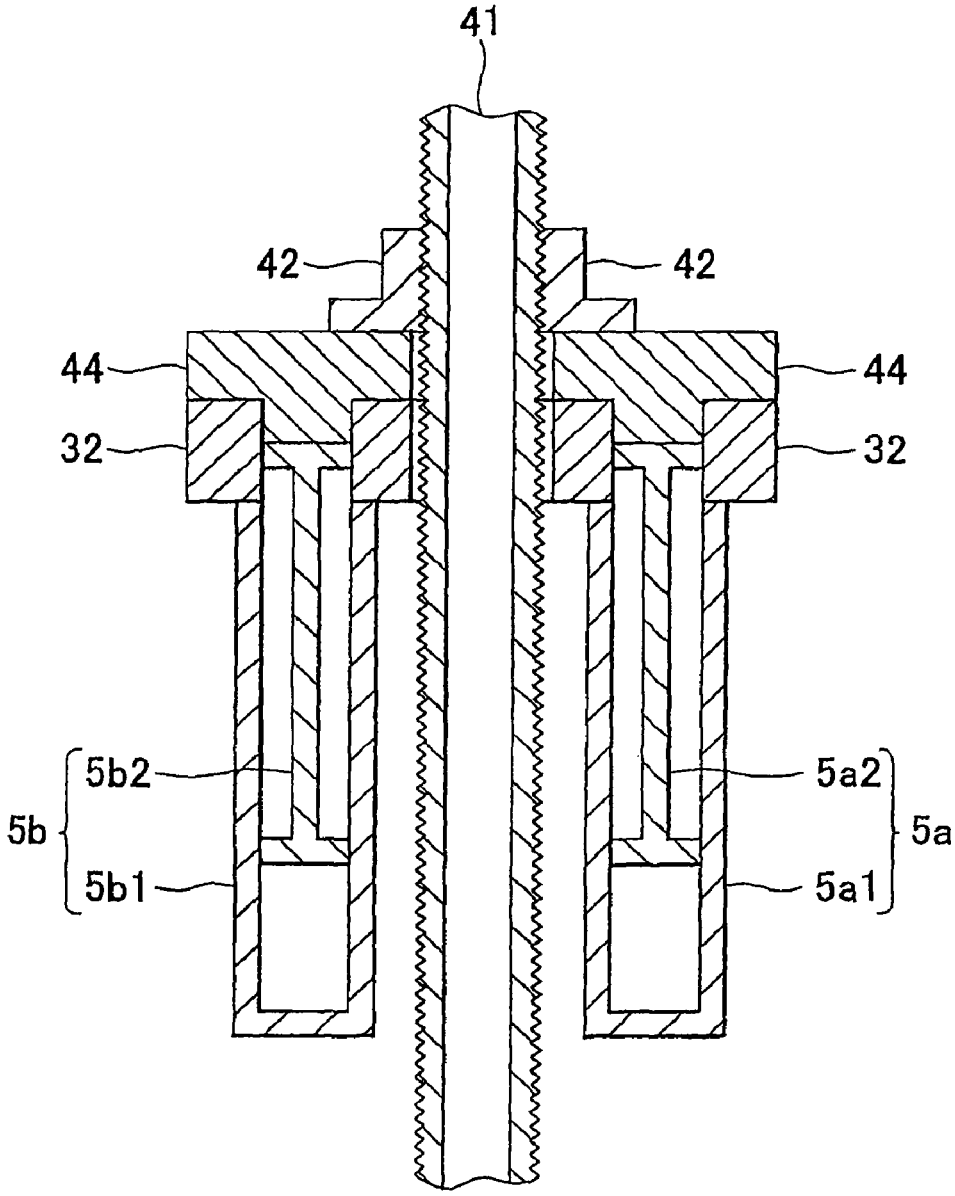
FIG. 6 is an arrow view taken along line VI-VI in FIG. 5.

FIG. 6 is an arrow view taken along line VI-VI in FIG. 5. From the drawing it is evident that the piston rods 5*a*2 and 5*b*2 of the pneumatic actuators 5*a* and 5*b* push the second mount 3 forward while the plate member receives the reaction force.

Figure 7:
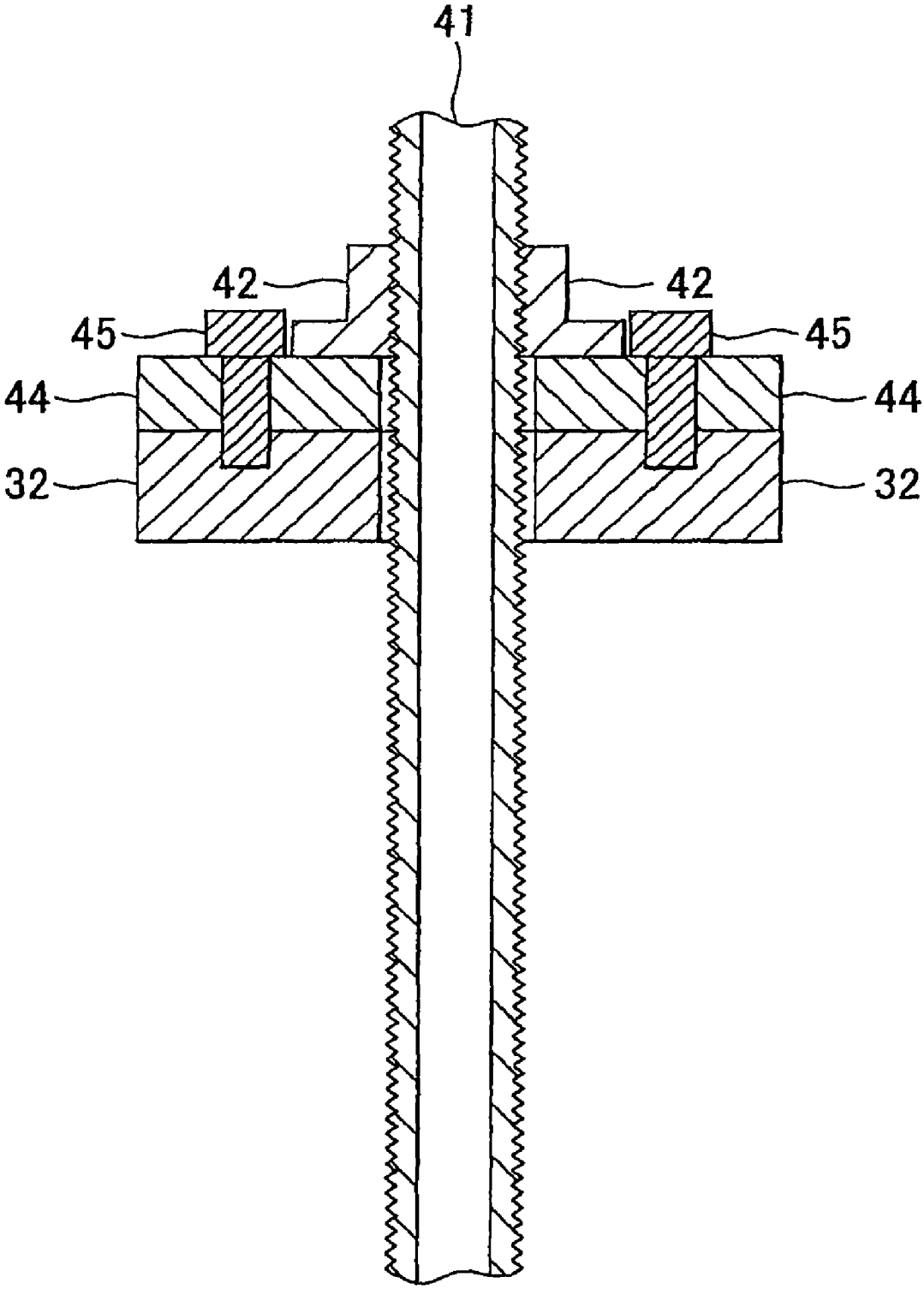
FIG. 7 is an arrow view taken along line VII-VII in FIG. 5.

Meanwhile, FIG. 7 is an arrow view taken along line VII-VII in FIG. 5. From this drawing it is evident that the plate member 44 which is fixed to the nut 42 can be attached to or detached from the second mount 3 (i.e., the other side 32 thereof) by the pin members 45 and 45.

Figure 8:
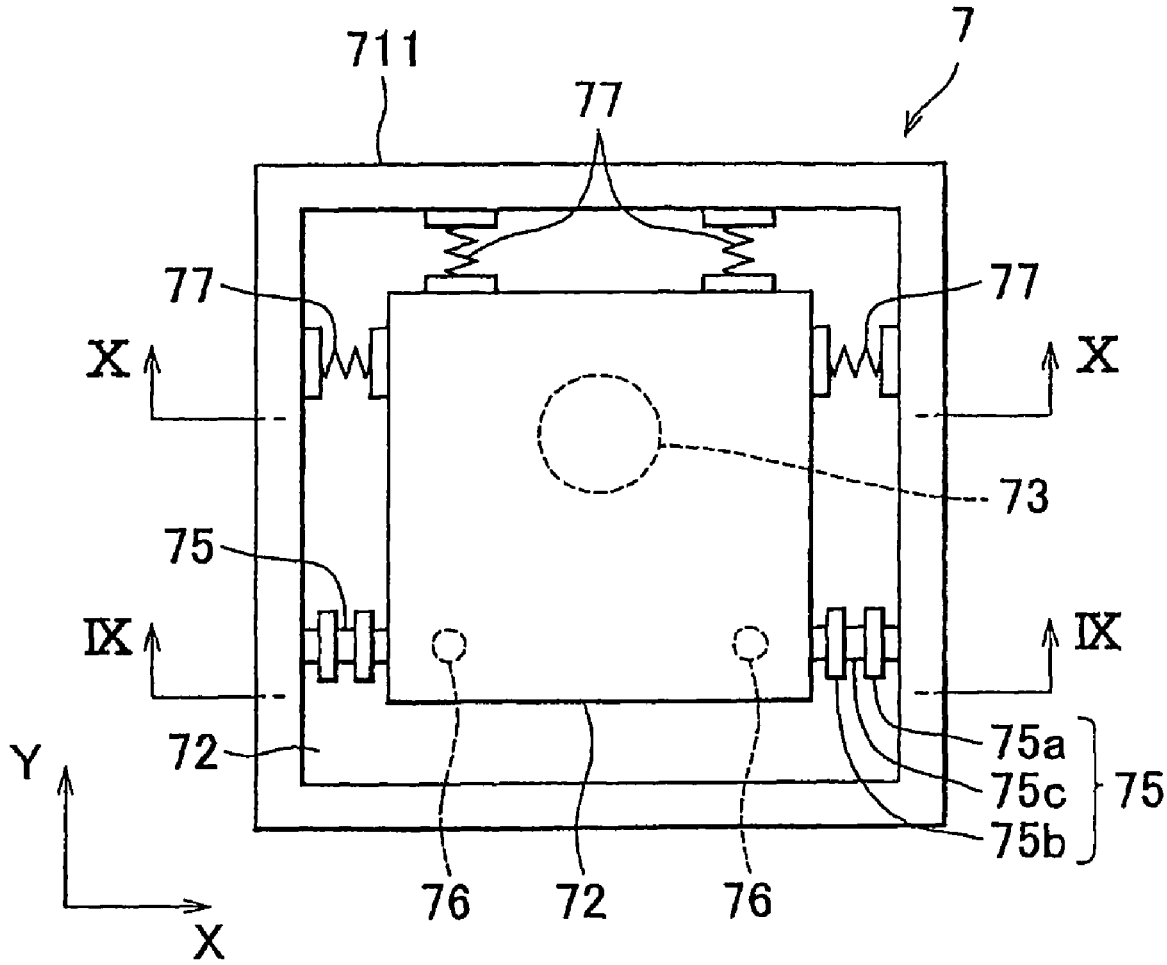
FIG. 8 is a plan view showing one example of a posture control device.
Figure 9:
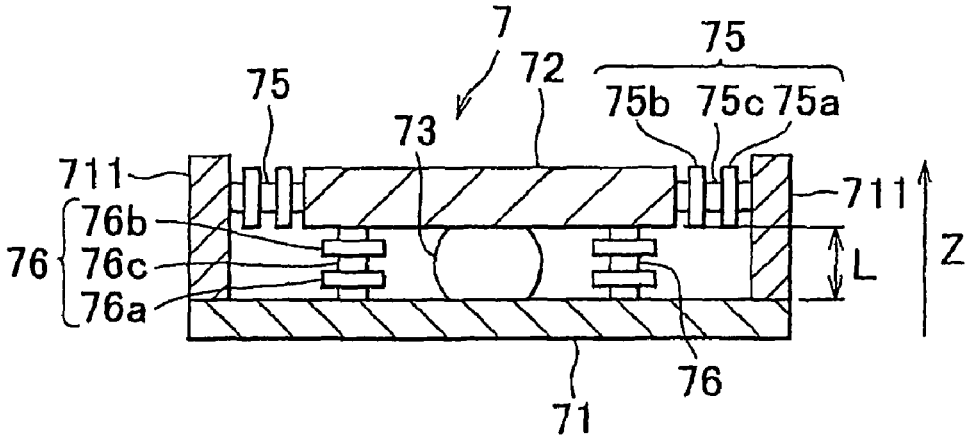
FIG. 9 is an arrow view taken along line IX-IX in FIG. 8.

FIG. 8 shows one example of the posture control device 7 and FIG. 9 is an arrow view taken along line IX-IX in FIG. 8. The posture control device 7 is a case which is open upward. This case includes a first plate member 71 and side walls 711 and can be made of SUS material, for example. A second plate member 72 is attached via second actuators 75 and 75 between the opposing side walls 711 and 711. In this case, even if the second plate member 72 tilts, an appropriate distance L at which that the second plate member 72 will not interfere with the first plate member 71 is ensured between the first plate member 71 and the second plate member 72. In the exemplary embodiment shown in the drawing, in addition to the second actuator 75, a plurality of springs 77, 77, . . . are interposed between the side walls 711 and the second plate member 72 to keep the second plate member 72 in the X-Y plane.

The second actuator 75 includes a shaft member 75*c* having an appropriate rigidity, a super magnetostrictive element 75*a*, and a piezoelectric element 75*b*. The super magnetostrictive element 75*a* is structured such that coil, not shown, is attached around an element. The super magnetostrictive element 75*a* is able to expand according to a magnetic field that is generated when current flows through the coil. The piezoelectric element 75*b* is also able to expand according to the application of voltage. The selection of whether to operate the super magnetostrictive element 75*a* or the piezoelectric element 75*b* can be made appropriately according to the machining stage, i.e., whether the second plate member 72 needs to be moved a relatively large amount. In this case, the super magnetostrictive element 75*a* can be formed from an alloy of nickel or iron and a rare-earth metal such as dysprosium or terbium, as it is conventionally. The piezoelectric element 75*b* can be formed from lead titanate (PbTiO3), barium titanate (BaTiO3), or lead zirconate titanate (Pb (Zr, Ti)O3).

For example, in a case where the posture control device 7 is mounted on the first mount 2, when displacing the second plate member 72 on the X-Y plane (i.e., in the horizontal direction), the second actuators 75 and 75 are operated, and when displacing the second plate member 72 in direction Z (i.e., in the vertical direction) the first actuators 76 and 76 are operated. In this case, the first actuator 76 includes a shaft member 76*c* of suitable rigidity, a super magnetostrictive element 76*a*, and a piezoelectric element 76*b*, just like the second actuator 75. The second plate member 72 is controlled to the appropriate posture by feeding back the measurement results relating to the thickness and evenness of the grinding target body a and sending a feedback command to the super magnetostrictive element or the piezoelectric element, and grinding is performed to adjust the thickness and evenness of the grinding target body a.

Figure 10:
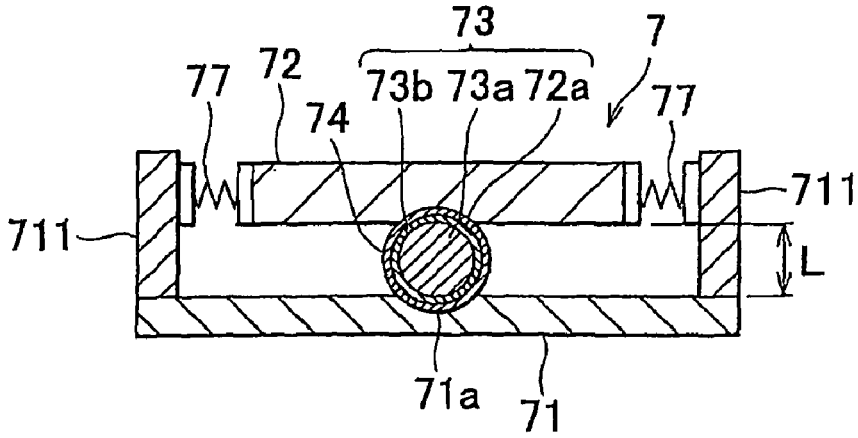
FIG. 10 is an arrow view taken along line X-X in FIG. 8.

In addition to the first actuators 76 and 76, a spherical body 73 is interposed between the first plate member 71 and the second plate member 72. This spherical body 73 is shown in detail in the sectional view of FIG. 10.

The spherical body 73 may include a spherical core portion 73*a* made of metal, for example, and a coating 73*b* made of graphite, for example, provided on the outer periphery of the core portion 73*a*. Moreover, a coating made of an adhesive 74 that can elastically deform at normal temperature is formed on the outer periphery of the coating 73*b*. In this case, the adhesive 74 used can be an adhesive (i.e., an elastic epoxy-based adhesive) in which the tensile shearing adhesion strength is 10 to 15 Mpa, the attenuation coefficient is 2 to 7 Mpa-sec, more preferably 4.5 Mpa-sec, and the spring coefficient of the adhesive is 80 to 130 GN/m, more preferably 100 GN/m. The thickness of the adhesive can be set to approximately 0.2 mm.

Concave portions 71*a* and 72*a* are formed in the first plate member 71 and the second plate member 72 at locations corresponding to the spherical body 73. Portions of the spherical body 73 fit into these concave portions 71*a* and 72*a* thereby positioning the spherical body 73. Also, the adhesive 74 that coats the outer periphery of the spherical body 73 is adhered to the concave portions 71*a* and 72*a* but not to the spherical body 73 (i.e., the coating 73*b* of the spherical body 73) so the spherical body 73 is able to rotate freely within the coating of the adhesive 74. Here, the spherical body 73 does not need to be adhered to both of the concave portions 71*a* and 72*a*; only one is sufficient. In this case, on the concave portion side that is not adhered, only an elastic member which has no adhesion force, instead of the adhesive, covers the spherical body 73.

When the posture of the rotating device 6*a* is controlled by operating the first actuator 76 and the second actuator 75 with the rotating device 6*a* mounted on the second plate member 72, elastic deformation of the coating formed of the adhesive 74 allows the second plate member 72 to be freely displaced three-dimensionally. At this time, the core member 73*a* of the spherical body 73 supports the weight of the rotating device 6*a* while only rotating in a fixed position without the coating formed of the outer peripheral adhesive 74 binding up. Accordingly, the spherical body 73 essentially only supports the weight of the rotating device 6*a* and is not attached to the adhesive 74 so the adhesive 74 is able to elastically deform according to the displacement of the second plate member 72 without any restriction on the spherical body 73. As a result, the second plate member 72 is restricted only an extremely minute amount that approximately corresponds to the reaction force from the elastic deformation of the adhesive 74.

Figures 11, 12:
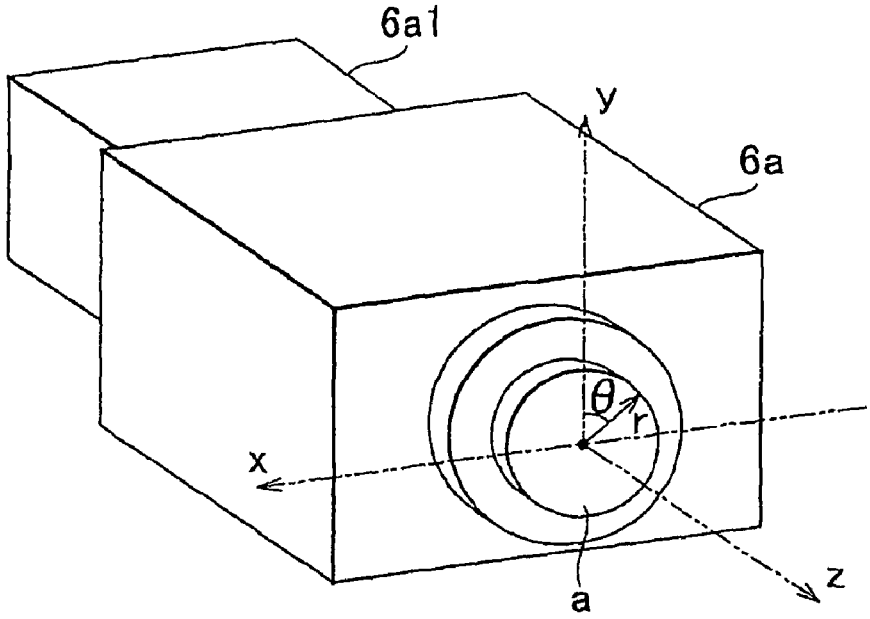
FIG. 11 is a view showing, in frame format, an actual coordinate system of a rotating device and the grinding target body, and the coordinate system light after A/D conversion by a computer.
FIG. 12 is a chart illustrating measurement results of the thickness at each coordinate on the surface of the grinding target body surface.

FIG. 11 a view showing, in frame format, an actual coordinate system of a rotating device and the grinding target body, and the coordinate system light after A/D conversion by a computer. The encoder 6*a*1 fixed to the rear of the rotating device 6*a*1 can read the rotation of the grinding target body a. In this case, the coordinate system of the rotating device 6*a* is set to the x-y-z axis shown in the drawing (the 2 axis is the axis in the axial directions of both the rotating device 6*b* and the rotating device 6*a*), and light waves are irradiated from the optical probes 91 and 92 described earlier on the rotating device 6*b* side. At the measuring point of the grinding target body a, the thickness at arbitrary coordinates (θ, r) is recorded in the computer 94. For example, FIG. 12 shows an example of recorded data at each measuring point when the radial direction is divided into 38 parts when the resolution of the encoder 6*a*1 (i.e., a rotary encoder) is 1024 (pulse/rev). It is then determined whether the difference between the measured data and the set thickness of the grinding target body at an arbitrary point corresponding to the data coordinates is within an allowable range. If that difference is outside of the allowable range, a feedback command is sent to the posture control device and an adjustment is made to bring that difference within the allowable range. An outline of the precision machining method of the grinding target body using the precision machining apparatus 1 described above is as follows.

The grinding method (i.e., precision machining method) of a grinding target body according to the invention is to be performed consistently from rough grinding to final ultra-precision grinding using only the precision machining apparatus 1. The first process of this method is to grind the grinding target body a by rough grinding it using a diamond wheel as the wheel b while moving the second mount 3 (the rotating device 6*b*) a predetermined amount with the feed-screw mechanism 4. Here, grinding can also be performed while sequentially using various types of diamond wheels having different roughnesses. In this rough grinding stage, the positions of the wheel b and the grinding target body a are detected and corrected by the posture control device 7 if their axial centers are misaligned.

Next in the second process, the wheel b is changed from the diamond wheel to a CMG wheel. This time, the pneumatic actuator 5*b* is operated to push the CMG wheel toward the grinding target body a while changing the constant pressure within a relatively high pressure region in a stepped manner. In the final stage of grinding, the actuator is switched to the pneumatic actuator 5*a* and final grinding of the grinding target body a is performed while changing the constant pressure within a low pressure region in a similar stepped manner. In this ultra-precision grinding stage as well, the positions of the wheel b and the grinding target body a are constantly detected and the positions are corrected by the posture control device 7 if their axial centers are misaligned.

Between the first and second processes, the thickness and evenness of the grinding target body a are measured as needed by the optical probes 91 and 92, as described above. Grinding is then performed while sending a feedback command based on these measurement results to the posture control device 7 and controlling the posture with the posture control device 7 so that the thickness and evenness can be made to match their respective target values or can be brought within the allowable range.

Also, between the first and second processes, it is desirable that the grinding target body a not become unchucked from the rotating device 6*a* so that no mottling remains on the surface of the grinding target body.

Chart 1 shows the set conditions for a grinding test performed by the inventors.

CHART 1

| Set conditions | Characteristics | Specifications |
|---|---|---|
| Cooling method | Freshwater | 20 ± 0.1° C. |
| Grinding target body | Silicon wafer | ϕ300 × 0.8 |
| Drive parameters | Wheel rotation speed | 40~1500 rpm |
| | Grinding target body rotation speed | 20~500 rpm |
| | Feeding speed | 0.5~20 μm/min |
| | Depth of cut | 2~20 μm |

Figure 13A:
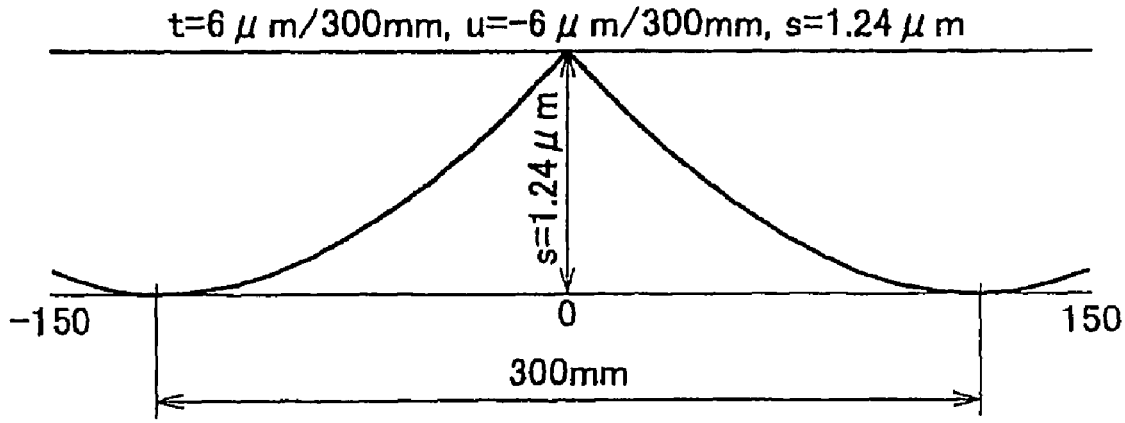
FIG. 13A is a view showing the maximum allowable value of the surface evenness (asperities) of a finished grinding target body.
Figure 13B:
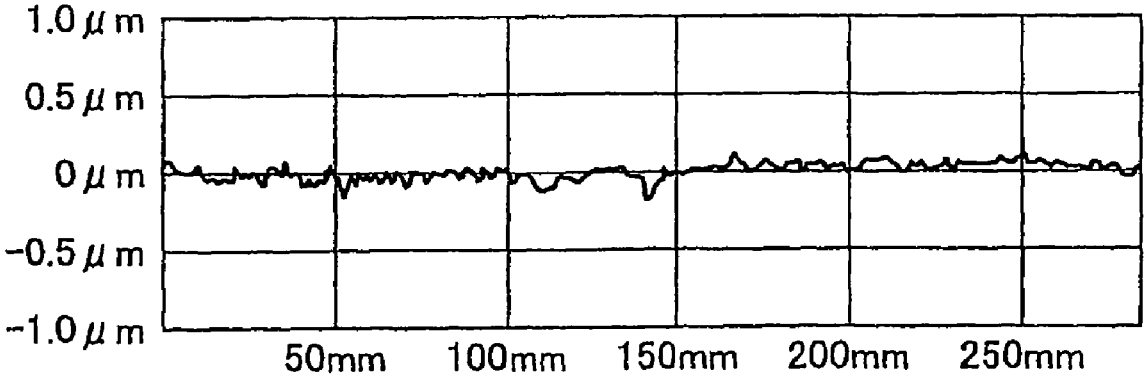
FIG. 13B is a view of a test result which shows differences in evenness along the diameter of the finished grinding target body.

Grinding the surface of the grinding target body is performed while the wheel is rotating by itself while revolving along the outer periphery of the grinding target body. Therefore, a ground cross-section of the surface of the grinding target body tends to take on a shape in which the center portion protrudes from the circumferential portion. FIG. 13A is view showing a frame format in which the allowable difference of the protrusion of the center portion of the grinding target body is set at 1.24 μm and the height difference between the diameter end portions of a silicon wafer that is 300 mm in diameter is ±6 μm/300 mm. FIG. 13B is a view illustrating the results when an arbitrary diameter of a finished grinding target body (i.e., silicon wafer) is selected and the difference along that diameter is measured. As is evident from FIG. 13B, the difference according to the test is able to be kept within the allowable value range. The thickness and evenness of the finished grinding target body is able to be precisely controlled with the precision machining apparatus that performs posture control with the posture control device by feedback control.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

The invention claimed is:

1. A precision machining apparatus comprising:

a first rotating device that rotates a grinding target body and a first mount that supports the first rotating device;

a second rotating device that rotates a wheel and a second mount that supports the second rotating device;

a moving device that selectively moves the first mount and the second mount closer to one another or farther away from one another;

a controller that controls the amount that the first and second mounts are moved by the moving device; and a measuring device that measures thickness and evenness of the grinding target body, and a posture control device that controls a posture of the first or second rotating devices, which is interposed between the first rotating device and the first mount or between the second rotating device and the second mount; wherein the moving device includes a first moving portion formed of a feed-screw mechanism and a second moving portion formed of an actuator that is based on pressure control, the moving device moving the first mount and the second mount relative to one another by selectively using the first moving portion and the second moving portion, and the controller is structured to adjust the amount that the first and second mounts are moved and/or the posture of the posture control device to obtain a predetermined thickness and evenness of the grinding target body based on measurement results obtained by the measuring device.

2. The precision machining apparatus according to claim 1, wherein the posture control device includes a first plate member which extends in a plane formed of an X axis and a Y axis and a second plate member which is parallel to and distanced from the first plate member; concave portions are formed in opposing surfaces of the two plate members; a spherical body is interposed between the first plate member and the second plate member, with portions of the spherical body fit into the two concave portions; a first actuator which expands in the direction of a Z axis that extends perpendicular to the plane formed of the X axis and the Y axis is also interposed between the first plate member and the second plate member; a second actuator which expands in an appropriate direction in the plane formed of the X axis and the Y axis is connected to the second plate member; the second plate member is structured to be able to move relative to the first plate member while an object is placed on the second plate member; the spherical body is attached to the first plate member and/or the second plate member by an adhesive which is able to elastically deform; a piezoelectric element and a super magnetostrictive element are provided on both the first actuator and the second actuator.

3. The precision machining apparatus according to claim 1, wherein the second moving portion includes a plurality of pneumatic actuators or hydraulic actuators of different pressure performances, and the movement of the second mount and the second rotating device by the second moving portion can be selectively controlled by different pressures.

4. The precision machining apparatus according to claim 1 wherein the wheel includes at least a CMG wheel.

5. A precision machining apparatus comprising:

a first rotating device that rotates a grinding target body and a first mount that supports the first rotating device;

a second rotating device that rotates a wheel and a second mount that supports the second rotating device;

a moving device that selectively moves the first mount and the second mount closer to one another or farther away from one another;

a controller that controls the amount that the first and second mounts are moved by the moving device; and a measuring device that measures thickness and evenness of the grinding target body, wherein the moving device includes a first moving portion formed of a feed-screw mechanism and a second moving portion formed of an actuator that is based on pressure control, the moving device moving the first mount and the second mount relative to one another by selectively using the first moving portion and the second moving portion;

a posture control device that controls the posture of the first or second rotating devices is interposed between the first rotating device and the first mount or between the second rotating device and the second mount; the posture control device includes a first plate member which extends in a plane formed of an X axis and a Y axis and a second plate member which is parallel to and distanced from the first plate member; concave portions are formed in opposing surfaces of the two plate members; a spherical body is interposed between the first plate member and the second plate member, with portions of the spherical body fit into the two concave portions; a first actuator which expands in the direction of a Z axis that extends perpendicular to the plane formed of the X axis and the Y axis is also interposed between the first plate member and the second plate member; a second actuator which expands in an appropriate direction in the plane formed of the X axis and the Y axis is connected to the second plate member; the second plate member is structured to be able to move relative to the first plate member while an object is placed on the second plate member; the spherical body is attached to the first plate member and/or the second plate member by an adhesive which is able to elastically deform; a piezoelectric element and a super magnetostrictive element are provided on both the first actuator and the second actuator; and the controller is structured such that the amount that the first and second mounts are moved and/or the posture of the posture control device is adjusted based on measurement results obtained by the measuring device to obtain a predetermined thickness and evenness of the grinding target body.

6. The precision machining apparatus according to claim 5, wherein the second moving portion includes a plurality of pneumatic actuators or hydraulic actuators of different pressure performances, and the movement of the second mount and the second rotating device by the second moving portion can be selectively controlled by different pressures.

7. The precision machining apparatus according to claim 5, wherein the wheel includes at least a CMG wheel.

8. A precision machining method using a precision machining apparatus which includes a first rotating device that rotates a grinding target body and a first mount that supports the first rotating device; a second rotating device that rotates a wheel and a second mount that supports the second rotating device; a moving device that selectively moves the first mount and the second mount closer to one another or farther away from one another; a controller that controls the amount that the first and second mounts are moved by the moving device; and a measuring device that measures thickness and evenness of the grinding target body; and a posture control device that controls the posture of the first or second rotating devices, which is interposed between the first rotating device and the first mount or between the second rotating device and the second mount, the moving device including a first moving portion formed of a feed-screw mechanism and a second moving portion formed of an actuator that is based on pressure control, comprising:

a first process of grinding the grinding target body by adjusting the movement of the first and second rotating devices and the first and second mounts using the first moving portion and rough grinding the grinding target body; and a second process of finishing the grinding target body by adjusting the movement of the first and second rotating devices and the first and second mounts using the second moving portion and grinding the ground grinding target body with a CMG wheel, wherein in the first process and the second process, the thickness and evenness of the grinding target body that was ground is measured by the measuring device and the amount that the first and second bases are moved and/or the posture of the posture control device is adjusted based on measuring results obtained by the measuring device to obtain a predetermined thickness and evenness of the grinding target body.

9. The precision machining method according to claim 8, wherein the transition from the first process to the second process is made without unchucking the grinding target body, which is chucked to the first rotating device, from the first rotating device.

10. The precision machining method according to claim 8, wherein in the first process and the second process, movement of the second mount and the second rotating device is selectively controlled by different pressures.

* * * * *